US009400440B2

(12) United States Patent
Wolfe et al.

(10) Patent No.: US 9,400,440 B2
(45) Date of Patent: Jul. 26, 2016

(54) STYRENE/ACRYLATE AND POLYESTER HYBRID TONER

(71) Applicant: Xerox Corporation, Norwalk, CT (US)

(72) Inventors: Christopher M Wolfe, Rochester, NY (US); Chieh-Min Cheng, Rochester, NY (US); Eric J Young, Webster, NY (US); Randy P Tin, Webster, NY (US); Jay L Schneider, Canandaigua, NY (US); Joo T Chung, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/561,543

(22) Filed: Dec. 5, 2014

(65) Prior Publication Data

US 2016/0161873 A1 Jun. 9, 2016

(51) Int. Cl.

| | |
|---|---|
| ***G03G 9/08*** | (2006.01) |
| ***G03G 9/093*** | (2006.01) |
| ***G03G 9/087*** | (2006.01) |

(52) U.S. Cl.

CPC ..... *G03G 9/09371* (2013.01); *G03G 9/0819* (2013.01); *G03G 9/0823* (2013.01); *G03G 9/08711* (2013.01); *G03G 9/08755* (2013.01); *G03G 9/09357* (2013.01)

(58) Field of Classification Search

CPC ..... G03G 9/08755; G03G 9/08711; G03G 9/09357

USPC ..... 430/109.4, 109.3, 110.2

See application file for complete search history.

(56) References Cited

U.S. PATENT DOCUMENTS

2015/0118613 A1* 4/2015 Nosella ..... G03G 9/08711 430/109.3

* cited by examiner

*Primary Examiner* — Mark A Chapman

(74) *Attorney, Agent, or Firm* — Marylou J. Lavoie, Esq. LLC

(57) ABSTRACT

The present disclosure describes toner particles that have polyester resin and styrene/acrylate resin in the core.

20 Claims, No Drawings

STYRENE/ACRYLATE AND POLYESTER HYBRID TONER

FIELD

The disclosure relates to toner particles prepared with a blend of a polyester latex and a styrene/acrylate latex in the core, wherein the styrene/acrylate resin reinforces the surface of the toner particles during coalescence providing uniformly sized populations of particles with fewer fine particles; toner with lower relative humidity (RH) sensitivity and a more durable surface; and toner with enhanced A zone and B zone charge.

BACKGROUND

Polyester latex provides toner with desirable rheologic properties in fusing and low minimum fix temperature. But polyester toner is sensitive to RH. Humidity impacts triboelectric charge of the polyester toner particles, which in turn, impacts xerographic performance and image quality.

Toner charge can be enhanced with external additives. That option, however, has shortcomings. The replenisher of the development system is subject to high forces imparted by, for example, the development auger, which causes impaction of additives into the toner surface. Toner particle residence time in the development system positively correlates with degree of additive impaction. Embedment of the external additive into the surface of the toner particle leads to undesirable toner charging behavior and poor print quality (in particular, areas of low toner coverage).

Accordingly, there remains a need to stabilize charge of toner particles prepared with polyester resins to capitalize on the desirable rheologic properties. That problem was addressed herein by preparing a hybrid toner comprising both polyester resin and styrene/acrylate resin in the core.

SUMMARY

The instant disclosure describes hybrid toner particles comprising a core comprising at least one polyester resin, at least one styrene/acrylate resin, an optional wax and an optional colorant in the core, wherein the hybrid toner particle possesses less sensitivity to relative humidity (RH) changes as compared to a polyester toner particle without the styrene/acrylate resin in the core. The toner has a shell. The toner can comprise a two-part developer.

In embodiments, a styrene/acrylate resin comprises no more than 10% of the total resin by weight of the hybrid toner core. In embodiments, the styrene/acrylate resin is selected from styrene acrylates, styrene butadienes, styrene methacrylates and combinations thereof.

In embodiments, the polyester resin is an amorphous resin, a crystalline resin or a combination thereof. The polyester resin may be a high molecular weight resin, a low molecular weight resin or a combination thereof.

DETAILED DESCRIPTION

A) Introduction

The present disclosure provides hybrid toner particles wherein the resin component of the toner core comprises a polyester resin and a styrene/acrylate resin. The hybrid toner particles are designed to maintain the desirable properties of polyester toner particles, e.g. fusing and low minimum fix temperature, while minimizing the shortcomings associated with polyester toners, such as, poor RH sensitivity and additive impaction.

Accordingly, the ratio of polyester resin to styrene/acrylate resin in the core may be varied, but is not more than 90:10 by weight, such as, about 91:09, about 92:08, about 93:07, about 94:06, about 95:05, about 96:04, about 97:03, 98:02 and so on, provided the desirable properties of the polyester resin are maintained.

In embodiments, the styrene/acrylate resin is present in the toner particle core at no more than 10% by weight of the core resins, no more than about 8%, no more than about 6%, no more than about 5% by weight of the core resins; in embodiments, from about 1% to 10% by weight, from about 2% to about 9%, from about 2.5 to about 7%, from about 3 to about 5% by weight of the toner particle core resins.

The present hybrid toner particles can be prepared by a number of different processes known to one of skill in the art, which include emulsion aggregation (EA), either by batch processes, continuous processes or combination thereof. In embodiments, the hybrid toner particles are prepared by a combination of batch and continuous processes wherein an emulsion of at least one polyester resin, at least one styrene/acrylate resin, optionally a wax and optionally a colorant are combined and mixed in a batch reactor, core particles are prepared and aggregation performed in the batch reactor. After freezing aggregation, and addition of a shell, the slurry of core/shell particles is fed into a continuous reactor to enable coalescence and to prepare the toner particles.

In embodiments, the hybrid toners comprise improved charging under varying humidity conditions. That enables tuning toner charge, for example, to obtain a toner with optimized composition and having optimized charge under a variety of environmental conditions. That toner is robust in having acceptable or beneficial charge in more than one environmental condition, in embodiments, plural environmental conditions, such as, A and B zones. Thus, a toner of interest is one which enables a multivariable optimization of composition and function for a combination of a number of environmental conditions.

For example, a toner of interest has a triboelectric charge of from about −60 to about −75 μC/g, from about −63 to about −73 μC/g, from about −64 to about −72 μC/g in the B zone (70° F., 50% RH). In embodiments, the hybrid toners have a triboelectric charge less than about −74 μC/g, less than about −72 μC/g, less than −70 μC/g, less than −68 μC/g in the B zone. Those values generally are lower than those of an analogous toner but not containing the styrene/acrylate resin(s). Varying styrene/acrylate content in the core enables tuning B zone charge and charge in at least one other zone.

The ratio of J zone (70° F./10% RH) charge to A zone (80° F., 80% RH) charge for a hybrid toner is lower than that of an analogous polyester toner not containing the styrene/acrylate resin(s), for example from about 1.3 to about 2.1, from about 1.4 to about 2, from about 1.5 to about 1.9, where the reduction in the ratio as compared to that of an analogous polyester-only toner derives primarily from increasing charge in the A zone, that is, a toner of interest maintains better charge under humid conditions. Hence, adjusting the amount of styrene/acrylate resin in the toner core enables maneuvering the A zone charge for better performance under humid conditions. That observation is coincident with the lowered and manipulable B zone charge mentioned above.

The BET surface area, multipoint determination, of the particles of interest is at least about 1 $\mu m^2/g$, at least about 1.4 $\mu m^2/g$, at least about 1.5 $\mu m^2/g$, at least about 1.6 $\mu m^2/g$ or more. The greater surface area of the particles of interest provides a greater number of surface sites for carrying charge or charged molecules, as well as other surface molecules for a desired purpose, function or property, as a design choice.

B) Definitions

As used herein, the modifier, "about," used in connection with a quantity is inclusive of the stated value and has the meaning dictated by the context (for example, it includes at least the degree of error associated with the measurement of the particular quantity). In embodiments, the terms of interest comprise a variation of less than about 10% from the stated value. When used in the context of a range, the modifier, "about," should also be considered as disclosing the range defined by the absolute values of the two endpoints. For example, the range, "from about 2 to about 4," also discloses the range, "from 2 to 4."

A toner of interest is one that contains a styrene/acrylate resin in the core. Comparisons are made between a toner of interest an one which is identical except does not contain any styrene/acrylate resin(s). Herein, the comparison or control toner is one which does not contain any styrene/acrylate resin in the core and is described in any of a number of ways, such as, "polyester-only toner," "styrene/acrylate-free toner," "polyester toner containing no styrene/acrylate resin(s)," "polyester toner free of styrene/acrylate resin(s)," "toner containing no styrene/acrylate resin(s)," "toner free of styrene/acrylate resin(s)," and so on. Other terms and phrases may be used and are contemplated, and are grounded on a polyester toner that does not contain any styrene/acrylate resin in the core.

A polymer can be identified or named herein by the two or more of the constituent monomers used to construct the polymer, even though following polymerization, a monomer is altered and no longer is identical to the original reactant. Thus, for example, a polyester often is composed of a polyacid monomer or component and a polyalcohol monomer or component. Thus, if a trimellitic acid reactant is used to make a polyester polymer, that polyester polymer can be identified herein as a trimellitic polyester.

C) Toner Particles

The hybrid toner particles of interest comprise a core comprising at least one polyester resin and at least one styrene/acrylate resin wherein the hybrid toner particle possesses one or more of less sensitivity to RH as compared to a polyester toner particle without the styrene/acrylate resin, where sensitivity to RH can be determined by measuring triboelectric charge of the toners under varying levels of humidity; uniform populations of particles; lower number of fine particles; improved and lower B zone charge; enhanced surface area; lower J/A ratio; higher A zone charge and so on.

The present hybrid toner particles may be combined with any additive package and/or carriers known in the art and formulated into a developer for imaging purposes. In embodiments, the toner particle is an EA toner.

a) Resins and Latexes

Any monomer suitable for preparing a styrene/acrylate latex for use in a toner may be utilized. Such latexes may be produced by conventional methods.

Suitable monomers include, but are not limited to, styrenes, acrylates, methacrylates, butadienes, isoprenes, acrylic acids, methacrylic acids, acrylonitriles, combinations thereof and the like. Exemplary monomers include, but are not limited to, styrene, alkyl acrylate, such as, methyl acrylate, ethyl acrylate, butyl acrylate, isobutyl acrylate, dodecyl acrylate, n-octyl acrylate, 2-chloroethyl acrylate; β-carboxy ethyl acrylate (β-CEA), phenyl acrylate, methyl α-chloroacrylate, methyl methacrylate (MMA), ethyl methacrylate and butyl methacrylate; butadiene; isoprene; methacrylonitrile; acrylonitrile; vinyl ethers, such as, vinyl methyl ether, vinyl isobutyl ether, vinyl ethyl ether and the like; vinyl esters, such as, vinyl acetate, vinyl propionate, vinyl benzoate and vinyl butyrate; vinyl ketones, such as, vinyl methyl ketone, vinyl hexyl ketone and methyl isopropenyl ketone; vinylidene halides, such as, vinylidene chloride and vinylidene chlorofluoride; N-vinyl indole; N-vinyl pyrrolidone; methacrylate (MA); acrylic acid; methacrylic acid; acrylamide; methacrylamide; vinylpyridine; vinylpyrrolidone; vinyl-N-methylpyridinium chloride; vinyl naphthalene; p-chlorostyrene; vinyl chloride; vinyl bromide; vinyl fluoride; ethylene; propylene; butylenes; isobutylene; and the like, and mixtures thereof.

Exemplary styrene/acrylate polymers include styrene acrylates, styrene butadienes, styrene methacrylates, and more specifically, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), poly(styrene-butadiene), poly(styrene-isoprene), poly(styrene-butyl methacrylate), poly(styrene-butyl acrylate-acrylic acid), poly(styrene-butyl methacrylate-acrylic acid), poly(butyl methacrylate-butyl acrylate), poly(butyl methacrylate-acrylic acid), poly(acrylonitrile-butyl acrylate-acrylic acid) and combinations thereof. The polymer may be block, random or alternating copolymers.

Illustrative examples of a styrene/acrylate latex copolymer includes poly(styrene-n-butyl acrylate-β-CEA), poly(styrene-alkyl acrylate), poly(styrene-1,3-diene), poly(styrene-alkyl methacrylate), poly(alkyl methacrylate-alkyl acrylate), poly(alkyl methacrylate-aryl acrylate), poly(aryl methacrylate-alkyl acrylate), poly(alkyl methacrylate), poly(styrene-alkyl acrylate-acrylonitrile), poly(styrene-1,3-diene-acrylonitrile), poly(alkyl acrylate-acrylonitrile), poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylonitrile), poly(styrene-butyl acrylate-acrylonitrile), and the like.

When plural monomers are used to make a copolymer, for example, styrene and alkyl acrylate, such as, a mixture comprising styrene, n-butyl acrylate and β-CEA. Based on total weight of the monomers, styrene may be present in an amount from about 1% to about 99%, from about 50% to about 95%, from about 70% to about 90%, although may be present in greater or lesser amounts; and acrylate(s) may be present in an amount from about 1% to about 99%, from about 5% to about 50%, from about 10% to about 30%, although may be present in greater or lesser amounts.

The styrene/acrylate resin particle can have a size from about 155 nm to about 215 nm, from about 165 nm to about 205 nm, from about 175 nm to about 195 nm. The styrene/acrylate resin particle can have a molecular weight from about 20 k to about 50 k, from about 25 k to about 45 k, from about 30 k to about 40 k.

Any polyester resin can be used, including the resins described in U.S. Pat. Nos. 6,593,049 and 6,756,176, the entire disclosure of each of which herein is incorporated by reference in entirety. The polyesters may be amorphous, crystalline or both. Suitable amorphous resins include those disclosed in U.S. Pat. No. 6,063,827, the entire disclosure of which herein is incorporated by reference in entirety. Suitable crystalline resins include those disclosed in U.S. Publ. No. 2006/0222991, the entire disclosure of which herein is incorporated by reference in entirety. Suitable polyester latexes also may include a mixture of an amorphous polyester resin and a crystalline polyester resin as described in U.S. Pat. No. 6,830,860, the entire disclosure of which herein is incorporated by reference in entirety.

In embodiments, an unsaturated polyester resin may be utilized as a polyester latex resin. Examples of such resins include those disclosed in U.S. Pat. No. 6,063,827, the entire disclosure of which herein is incorporated by reference in entirety. Exemplary unsaturated polyester resins include, but are not limited to, poly(1,2-propylene fumarate), poly(1,2-propylene maleate), poly(1,2-propylene itaconate) and so on, and combinations thereof.

In what follows, an, "acid-derived component," or functional variations thereof indicates a constituent moiety or monomer that was originally an acid component before incorporation into in synthesis of a polyester polymer and an, "alcohol-derived component," or functional variations thereof indicates a constituent moiety or monomer that was originally an alcoholic component before incorporation into in synthesis of the polyester polymer resin.

The polyester polymer can be formed by reacting a polyol with a polyacid in the presence of an optional catalyst. Polycondensation catalysts which may be utilized in forming either the crystalline or amorphous polyesters include tetraalkyl titanates, dialkyltin oxides, such as, dibutyltin oxide; tetraalkyltins, such as, dibutyltin dilaurate; and dialkyltin oxide hydroxides, such as, butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole % to about 5 mole % based on the starting polyacid or polyester used to generate the polyester resin.

A, "crystalline polyester resin," is one that shows not a stepwise endothermic amount variation but a clear endothermic peak in differential scanning calorimetry (DSC). However, a polymer obtained by copolymerizing the crystalline polyester main chain and at least one other component also is called a crystalline polyester if the amount of the other component is 50% by weight or less.

Monomer polyacids having 6 to 10 carbon atoms may be desirable for obtaining suitable crystal melting point and charging properties. To improve crystallinity, a straight chain polycarboxylic acid may be present in an amount of about 95% by mole or more of the acid component, more than about 98% by mole of the acid component. Other polyacids are not particularly restricted and examples thereof include conventionally known polycarboxylic acids and polyhydric alcohols, for example, those described in, "Polymer Data Handbook: Basic Edition," (Soc. Polymer Science, Japan Ed.: Baihukan). As the alcohol component, aliphatic polyalcohols having from about 6 to about 10 carbon atoms may be used to obtain desirable crystal melting points and charging properties. To raise crystallinity, it may be useful to use the straight chain polyalcohols in an amount of about 95% by mole or more, about 98% by mole or more.

For forming a crystalline polyester, suitable polyols include aliphatic polyols with from about 2 to about 36 carbon atoms, such as, 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic polyol may be, for example, selected in an amount of from about 40 to about 60 mole %, from about 42 to about 55 mole %, from about 45 to about 53 mole % (although amounts outside of those ranges can be used).

Examples of polyacids or polyesters including vinyl polyacids or vinyl polyesters selected for the preparation of the crystalline resins include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassio salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfoexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The polyacid may be selected in an amount of from about 40 to about 60 mole %, from about 42 to about 52 mole %, from about 45 to about 50 mole %.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly (hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), alkali copoly(5-sulfoisophthaloyl)-copoly(ethylene-adipate), alkali copoly (5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly (ethylene-adipate), alkali copoly(5-sulfo-isophthaloyl)-copoly (propylene-adipate), alkali copoly(5-sulfo-isophthaloyl)-copoly(butylene-adipate), alkali copoly(5-sulfo-isophthaloyl)-copoly(pentylene-adipate), alkali copoly (5-sulfo-isophthaloyl)-copoly(hexylene-adipate), alkali copoly(5-sulfo-isophthaloyl)-copoly(octylene-adipate), alkali copoly(5-sulfoisophthaloyl)-copoly(ethylene-succinate), alkali copoly(5-sulfoisophthaloyl-copoly(propylene-succinate), alkali copoly(5-sulfoisophthaloyl)-copoly(butylenes-succinate), alkali copoly(5-sulfoisophthaloyl)-copoly (pentylene-succinate), alkali copoly(5-sulfoisophthaloyl)-copoly(hexylene-succinate), alkali copoly(5-sulfoisophthaloyl)-copoly(octylene-succinate), alkali copoly (5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly (octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly (5-sulfo-isophthaloyl)-copoly(pentylene-adipate), alkali copoly(5-sulfo-isophthaloyl)-copoly(hexylene-adipate), poly(octylene-adipate), wherein alkali is a metal like sodium, lithium or potassium. Examples of polyamides include poly (ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide), and poly(butylene-succinimide).

The crystalline resin may be present, for example, in an amount of from about 4 to about 14% by weight of the toner components, from about 5 to about 12%, from about 6 to about 10% by weight of the toner resins. The crystalline resin can possess various melting points of, for example, from about 30° C. to about 120° C., from about 50° C. to about 90° C. The crystalline resin may have a weight average molecular weight (Mw), as measured by gel permeation chromatography (GPC) of, for example, from about 15,000 to about 30,000, from about 20,000 to about 25,000. The molecular weight distribution (Mw/Mn) of the crystalline resin may be, for example, from about 2 to about 6, from about 3 to about 5. The crystalline resin particles can be from about 170 to about 230 nm in size, from about 180 to about 220 nm, from about 190 to about 210 nm in size.

Examples of polyacids or polyesters including vinyl polyacids or vinyl polyesters utilized for the preparation of amorphous polyesters include polycarboxylic acids or polyesters, such as, terephthalic acid, phthalic acid, isophthalic acid, fumaric acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The polyacid or polyester may be present, for example, in an amount from about 40 to about 60 mole % of the resin, from about 42 to about 52 mole T of the resin, from about 45 to about 50 mole T of the resin.

Examples of additional polyols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, 1,4-cyclohexanedimethanol, 1,3-cyclohexanedimethanol, xylenedimethanol, cyclohexanediol, diethylene glycol, dipropylene glycol, dibutylene, and combinations thereof. The amount of polyol selected can vary, and may be present, for example, in an amount from about 40 to about 60 mole % of the resin, from about 42 to about 55 mole % of the resin.

A high molecular weight (HMW) amorphous resin can have a molecular weight from about 70 k to about 84 k, from about 72 k to about 82 k, from about 74 k to about 80 k. A low molecular weight (LMW) amorphous resin can have a molecular weight from about 12 k to about 24 k, from about 14 k to about 22 k, from about 16 k to about 20 k.

The amorphous resin particles can be from about 170 to about 230 nm, from about 180 to about 220 nm, from about 190 to about 210 nm in size.

The total amount of amorphous resin in the toner core can be from about 75% to about 90% by weight, from about 77% to about 87%, from about 78% to about 85% by weight of the resins in the toner core.

The polyester resins may be synthesized from a combination of components selected from the above-mentioned monomer components, by using conventional known methods. Exemplary methods include the ester exchange method and the direct polycondensation method, which may be used singularly or in a combination thereof. The molar ratio (acid component/alcohol component) when the acid component and alcohol component are reacted, may vary depending on the reaction conditions. The molar ratio is usually about 1/1 in direct polycondensation. In the ester exchange method, a monomer, such as, ethylene glycol, neopentyl glycol or cyclohexanedimethanol, which may be distilled away under vacuum, may be used in excess.

Any suitable surfactant may be used for the preparation of a latex, pigment or wax dispersion according to the present disclosure. Depending on the emulsion system, any desired nonionic or ionic surfactant, such as, anionic or cationic surfactant, may be contemplated.

Examples of suitable anionic surfactants include, but are not limited to, sodium dodecylsulfate (SDS), sodium dodecylbenzene sulfonate, sodium dodecylnaphthalenesulfate, dialkyl benzenealkyl sulfates and sulfonates, abitic acid, NEOGEN R® and NEOGEN SC® available from Kao, Tayca Power®, available from Tayca Corp., DOWFAX®, available from Dow Chemical Co., and the like, as well as mixtures thereof.

Examples of suitable cationic surfactants include, but are not limited to, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$,$C_{17}$-trimethyl ammonium bromides, halide salts of quaternized polyoxyethylalkylamines, dodecylbenzyl triethyl ammonium chloride, MIRAPOL® and ALKAQUAT® (available from Alkaril Chemical Company), SANIZOL® (benzalkonium chloride, available from Kao Chemicals), and the like, as well as mixtures thereof.

Examples of suitable nonionic surfactants include, but are not limited to, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy)ethanol (available from sanofi as ANTAROX 890®, IGEPAL CA-210®, IGEPAL CA-520®, IGEPAL CA-720®, IGEPAL CO-890®, IGEPAL CO-720®, IGEPAL CO-290®, IGEPAL CA-210® and ANTAROX 897®) and the like, as well as mixtures thereof.

Surfactants may be employed in any desired or effective amount, for example, at least about 0.01% by weight of the reactants, at least about 0.1% by weight of the reactants; and no more than about 10% by weight of the reactants, no more than about 5% by weight of the reactants. although the amount can be outside of those ranges.

A suitable initiator or mixture of initiators may be used in the latex process and the toner process. In embodiments, the initiator is selected from known free radical polymerization initiators. Examples of suitable free radical initiators include, but are not limited to, peroxides, pertriphenylacetate, tert-butyl performate, sodium persulfate, azo compounds and the like.

Based on total weight of the monomers to be polymerized, the initiator may be present in an amount from about 0.1% to about 5%, from about 0.4% to about 4%, from about 0.5% to about 3%, although may be present in greater or lesser amounts.

A chain transfer agent optionally may be used to control the polymerization degree of the latex, and thereby control the molecular weight and molecular weight distribution of the product latexes of the latex process and/or the toner process according to the present disclosure. As can be appreciated, a chain transfer agent can become part of the latex polymer.

A chain transfer agent can have a carbon-sulfur covalent bond. The carbon-sulfur covalent bond has an absorption peak in a wave number region ranging from 500 to 800 $cm^{-1}$ in an infrared absorption spectrum. When the chain transfer agent is incorporated into the latex and the toner made from the latex, the absorption peak may be changed, for example, to a wave number region of 400 to 4,000 $cm^{-1}$.

Exemplary chain transfer agents include, but are not limited to, n-$C_{3-15}$ alkylmercaptans; branched alkylmercaptans; aromatic ring-containing mercaptans; and so on. Examples of such chain transfer agents also include, but are not limited to, dodecanethiol, butanethiol, isooctyl-3-mercaptopropionate, 2-methyl-5-t-butyl-thiophenol, carbon tetrachloride, carbon tetrabromide and the like. The terms, "mercaptan," and, "thiol," may be used interchangeably to mean C—SH group.

Based on total weight of the monomers to be polymerized, the chain transfer agent may be present in an amount from about 0.1% to about 7%, from about 0.5% to about 6%, from about 1.0% to about 5%, although may be present in greater or lesser amounts.

In embodiments, a branching agent optionally may be included in the first/second monomer composition to control the branching structure of the target latex. Exemplary branching agents include, but are not limited to, decanediol diacrylate (ADOD), trimethylolpropane, pentaerythritol, trimellitic acid, pyromellitic acid and mixtures thereof.

Based on total weight of the monomers to be polymerized, the branching agent may be present in an amount from about 0% to about 2%, from about 0.05% to about 1.0%, from about 0.1% to about 0.8%, although may be present in greater or lesser amounts.

In the latex process and toner process of the disclosure, emulsification may be done by any suitable process, such as, mixing, optionally, at elevated temperature. For example, the emulsion mixture may be mixed in a homogenizer set at about 200 to about 400 rpm and at a temperature of from about 20° C. to about 80° C. for a period of from about 1 min to about 20 min, although temperatures and times outside of those ranges can be used.

Any type of reactor may be used without restriction. The reactor can include means for stirring the compositions therein, such as, an impeller. A reactor can include at least one impeller. For forming the latex and/or toner, the reactor can be operated throughout the process such that the impellers can operate at an effective mixing rate of about 10 to about 1,000 rpm.

Following completion of the monomer addition, the latex may be permitted to stabilize by maintaining the conditions for a period of time, for example for about 10 to about 300 min, before cooling. Optionally, the latex formed by the above process may be isolated by standard methods known in the art, for example, coagulation, dissolution and precipitation, filtering, washing, drying or the like.

The latex of the present disclosure may be melt blended or otherwise mixed with various toner ingredients, such as, an optional wax dispersion, an optional colorant, an optional coagulant, an optional silica, an optional charge enhancing additive or charge control additive, an optional surfactant, an optional emulsifier, an optional flow additive and the like. Optionally, the latex (e.g. around 40 solids) may be diluted to the desired solids loading (e.g. about 12 to about 15% by weight solids), before formulated in a toner composition.

Based on the total toner weight, the latex may be present in an amount from about 50% to about 98%, although may be present in lesser amounts. Methods of producing such latex resins may be carried out as described in the disclosure of U.S. Pat. No. 7,524,602, the entire content of which herein is incorporated by reference in entirety.

b) Colorants

Various known suitable colorants, such as dyes, pigments, mixtures of dyes, mixtures of pigments, mixtures of dyes and pigments and the like may be included in the toner.

The colorant may be included in the toner in an amount of, for example, 0 to about 35% by weight of the toner, from about 1 to about 25% of the toner, from about 3 to about 20% by weight of the toner, although amounts outside those ranges may be utilized.

As examples of suitable colorants, mention may be made of carbon black like REGAL 330®; magnetites, such as, Mobay magnetites MO8029™ and MO8060™; Columbian magnetites; MAPICO BLACKS™, surface-treated magnetites; Pfizer magnetites CB4799™, CB5300™, CB5600™ and MCX6369™; Bayer magnetites, BAYFERROX 8600™ and 8610™; Northern Pigments magnetites, NP-604™ and NP-608™; Magnox magnetites TMB-100™ or TMB-104™; and the like. As colored pigments, there can be selected cyan, magenta, yellow, red, green, brown, blue or mixtures thereof. Generally, cyan, magenta or yellow pigments or dyes, or mixtures thereof, are used. The pigment or pigments can be water-based pigment dispersions.

Specific examples of pigments include SUNSPERSE 6000, FLEXIVERSE and AQUATONE water-based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhblich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corp., Ltd., Toronto, CA, NOVAPERM YELLOW FGL™, HOSTAPERM PINK E™ from sanofi, CINQUASIA MAGENTA™ available from E.I. DuPont de Nemours & Co. and the like. Colorants that can be selected are black, cyan, magenta, yellow and mixtures thereof. Examples of magenta colorants are 2,9-dimethyl-substituted quinacridone and anthraquinone dye identified in the Color Index (CI) as CI 60710, CI Dispersed Red 15, diazo dye identified in the Color Index as CI 26050, CI Solvent Red 19 and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, Anthrathrene Blue, identified in the Color Index as CI 69810, Special Blue X-2137 and the like. Examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide and Permanent Yellow FGL. Colored magnetites, such as, mixtures of MAPICO BLACK™, and cyan components also may be selected as colorants. Other known colorants can be selected, such as, Levanyl Black A-SF (Miles, Bayer) and Sunsperse Carbon Black LHD 9303 (Sun Chemicals), and colored dyes, such as, Neopen Blue (BASF), Sudan Blue OS (BASF), PV Fast Blue B2G01 (sanofi), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (sanofi), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (sanofi), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann, CA), E.D. Toluidine Red (Aldrich), Lithol Rubine Toner (Paul Uhlich), Lithol Scarlet 4440 (BASF), Bon Red C (Dominion Color Co.), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing and the like.

c) Wax

In addition to the polymer resin, the toners of the present disclosure also may contain a wax, which can be either a single type of wax or a mixture of two or more different waxes. When included, the wax may be present in an amount of, for example, from about 1 wt % to about 25 wt % of the toner particles, from about 5 wt % to about 20 wt % of the toner particles. The melting point of a wax can be at least about 60° C., at least about 70° C., at least about 80° C. Waxes that may be selected include waxes having, for example, a weight average molecular weight of from about 500 to about 20,000, from about 1,000 to about 10,000. Wax particles can be from about 125 nm to about 250 nm, from about 150 to about 225 nm, from about 175 to about 200 nm in size.

Waxes that may be used include, for example, polyolefins, such as, polyethylene, polypropylene and polybutene waxes, such as, commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K.K.; plant-based waxes, such as, carnauba wax, rice wax, candelilla wax, sumacs wax and jojoba oil; animal-based waxes, such as, beeswax; mineral-based waxes and petroleum-based waxes, such as, montan wax, ozokerite, ceresin, paraffin wax, microcrystalline wax and Fischer-Tropsch wax; ester waxes obtained from higher fatty acid and higher alcohol, such as, stearyl stearate and behenyl behenate; ester waxes obtained from higher fatty acid and monovalent or multivalent lower alcohol, such as, butyl stearate, propyl oleate, glyceride monostearate, glyceride distearate, pentaerythritol tetra behenate; ester waxes obtained from higher fatty acid and multivalent alcohol multimers, such as, diethyleneglycol monostearate, dipropyleneglycol distearate, diglyceryl distearate and triglyceryl tetrastearate; sorbitan higher fatty acid ester waxes, such as, sorbitan monostearate, and cholesterol higher fatty acid ester waxes, such as, cholesteryl stearate. Examples of functionalized waxes that may be used include, for example, amines, amides, for example, AQUA SUPERSLIP 6550™ and SUPERSLIP 6530™ available from Micro Powder Inc., fluorinated waxes, for example, POLYFLUO 190™, POLYFLUO 200™, POLYSILK 19™ and POLYSILK 14™ available from Micro Powder Inc., mixed fluorinated, amide waxes, for example, MICROSPERSION 19™ available from Micro Powder Inc., imides, esters, quaternary amines, carboxylic acids or acrylic polymer emulsion, for example JONCRYL 74™, 89™, 130™, 537™ and 538™, all available from SC Johnson Wax, and chlorinated polypropylenes and polyethylenes available from Allied Chemical and Petrolite Corporation and SC Johnson wax. Mixtures and combinations of the foregoing waxes also may be used in embodiments.

d) Toner Preparation

The toner particles may be prepared by any method within the purview of one skilled in the art. Although embodiments relating to toner particle production are described below with respect to EA processes, any suitable method of preparing toner particles may be used, including chemical processes, such as, suspension and encapsulation processes disclosed in U.S. Pat. Nos. 5,290,654 and 5,302,486, the entire disclosure of each of which herein is incorporated by reference in entirety.

Toner compositions may be prepared by EA processes, such as, a process that includes aggregating a mixture of at least one polyester resin, at least one styrene/acrylate resin, an optional wax and any other desired or required additives, and emulsions including the resins described above, optionally with surfactants, as described above to form a mixture in a batch reactor. The pH of the resulting mixture may be adjusted by an acid, such as, for example, acetic acid, nitric acid or the like. In embodiments, the pH of the mixture may be adjusted to from about 2 to about 4.5. Additionally, in embodiments, the mixture may be homogenized. If the mixture is homogenized, homogenization may be accomplished by mixing at about 600 to about 4,000 revolutions per minute (rpm). Homogenization may be accomplished by any suitable means, including, for example, with an IKA ULTRA TURRAX T50 probe homogenizer.

The polyester and styrene/acrylate resins are mixed with optional surfactant to form a resin emulsion. The resin particles can have a size from about 100 nm to about 250 nm, from about 120 nm to about 230 nm, from about 130 nm to about 220 nm, although the particle size can be outside of those ranges. The combined hybrid resin particles then are combined with any optional wax, any optional colorant and other toner reagents as a design choice.

Following preparation of the above mixture, an aggregating agent (or coagulant) is added to the mixture. Suitable aggregating agents include, for example, aqueous solutions of a divalent cation or a multivalent cation material. The aggregating agent may be, for example, polyaluminum halides, such as, polyaluminum chloride (PAC), or the corresponding bromide, fluoride or iodide, polyaluminum silicates, such as, polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature ($T_g$) of the resin.

The aggregating agent may be added to the mixture to form a toner in an amount of, for example, from about 0.1 parts per hundred (pph) to about 5 pph, from about 0.25 pph to about 4 pph.

To control aggregation and coalescence of the particles, the aggregating agent may be metered into the mixture over time. For example, the agent may be metered into the mixture over a period of from about 5 to about 240 min, from about 30 to about 200 min. Addition of the agent may also be done while the mixture is maintained under stirred conditions, in embodiments, from about 50 rpm to about 1,000 rpm, from about 100 rpm to about 500 rpm, and at a temperature that is below the $T_g$ of the resin.

The aggregation thus may proceed by maintaining the elevated temperature, or slowly raising the temperature to, for example, from about 40° C. to about 100° C., and holding the mixture at that temperature for a time from about 0.5 hr to about 6 hr, from about 1 hr to about 5 hr, while maintaining stirring, to provide the aggregated particles The particles may be permitted to aggregate until a predetermined desired particle size is obtained. Particle size can be monitored as known in the art, for example, with a COULTER COUNTER, for average particle size. In embodiments, the particle size may be about 4 to about 7 μm, from about 4.5 to about 6.5 μm, from about 5 to about 6 μm.

Once the desired final size of the toner particles is achieved, the pH of the mixture may be adjusted with a base to a value of from about 6 to about 10, from about 5 to about 8. The adjustment of the pH may be utilized to freeze, that is, to stop, toner growth. The base utilized to stop toner growth may include any suitable base, such as, for example, alkali metal hydroxides, such as, for example, sodium hydroxide, potassium hydroxide, ammonium hydroxide, combinations thereof and the like. In embodiments, a chelator, such as, ethylenediamine tetraacetic acid (EDTA) may be added to help adjust the pH to the desired values noted above.

The gloss of a toner may be influenced by the amount of retained metal ion, such as, $Al^{3+}$, in the particle. In embodiments, the amount of retained metal ion, for example. $Al^{3+}$, in toner particles of the present disclosure may be from about 0.1 pph to about 1 pph, from about 0.25 pph to about 0.8 pph.

e) Shell

In embodiments, a shell may be applied to the formed aggregated toner particles. Any one or more amorphous resins described above or as known in the art may be utilized as the shell resin. The shell resin may be applied to the aggregated particles by any method within the purview of those skilled in the art The aggregated particles described above are combined with said emulsion so that the resin forms a shell over the formed aggregated toner particles.

Toner particles can have a diameter of from about 4 to about 8 μm, from about 5 to about 7 μm, and the optional shell component may comprise about 20 to about 40% by weight of the toner particles, from about 22 to about 36%, from about 24 to about 32% by weight of the toner particles. In embodiments, the shell has a higher $T_g$ than that of the aggregated toner particles or the core particle.

In embodiments, a photoinitiator, a branching agent and the like may be included in the resin mixture for forming the shell. In embodiments, the shell resin may be in an emulsion including any surfactant described herein. The shell may contain a conductive material, such as, a colorant, such as, a carbon black.

f) Coalescence

Following aggregation to the desired particle size, with formation of a shell as described above, the particles then are coalesced to the desired final shape, the coalescence being achieved by, for example, heating the mixture to a temperature of from about 55° C. to about 100° C., from about 60° C. to about 95° C., which may be below the melting point of a crystalline resin to prevent plasticization. Higher or lower temperatures may be used, it being understood that the temperature is a function of the resins used.

Coalescence may proceed over a period of from about 1 min to about 9 hr, from about 2 min to about 4 hr, although times outside of those ranges can apply, for example, depending whether coalescence occurs in a batch reactor or in a microreactor.

In a continuous system or reactor, or a microreactor, reduced volumes of reagents are coursed in a unidirectional manner through the reactor. Aggregated particles and reactants, often in a slurry, from a batch or continuous reactor are fed continuously, discontinuously or metered at controllable rates and in controllable amounts by communicating devices, such as, lines, conduits, tubing and so on, composed of suitable materials, to and for incubation in the continuous reactor. The communicating devices can comprise and the continuous reactor comprises one or more devices for controlling temperature of the contents therein, such as, a heating or cooling element. The heating and cooling elements can be positioned along the communication devices and along the flow path of the continuous reactor to provide a controlled or particular temperature profile for the communicated reactants within the communication device and the reactor or reactor unit and the aggregated particle slurry in the continuous reactor. A pump or urging device can cause movement of the slurry from the batch reactor to the continuous reactor. The continuous reactor can comprise other urging devices to maintain a desired flow rate therethrough.

The continuous reactor can comprise a series of tubes, channels, voids, tubular voids, voids within partially flattened or ovoid tubes and the like, any suitable flow path, wherein plural such continuous reactors can be connected in parallel, for example via a manifold, to provide in series a continuous directed flow path through a plurality of devices that comprise the reactor. The continuous reactor can comprise one or more temperature regulating devices, such as, a heating or cooling element, which can comprise a liquid, such as, an oil, that bathes the directed parallel flow path to provide the appropriate temperature or temperature profile along the flow path under which the reaction occurs. The flow path can be connected to an egress device by a communication device, such as, a line, conduit, tubing and the like to course the reacted mixture to a product receiving vessel. The reaction apparatus can be operated under pressure to reduce reagent and fluid boiling points and to ensure unimpeded or continuous movement and uniform flow of the reaction mixture through the reactor.

In embodiments, a continuous reactor of interest comprises a plurality of units comprising, for example, about four regions, flow paths, fluid flow paths, zones, subparts, sections and the like, where each region, zone and the like provides a different environment or different conditions for the slurry contained therein, such as, one region provides a ramping of conditions for coalescence and another subsequent zone can be one where coalescence of particles occurs. In embodiments, the reactor comprises multiple units, parts, components and the like that are operably connected to provide a continuous flow path, where each unit provides a different environment for the contained slurry, and which is where a separate process of toner development occurs.

After coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles optionally may be washed with water and then dried. Drying may be accomplished by any suitable method, for example, freeze drying.

g) Additives

Toner particles also may contain other optional additives, as desired or required. For example, the toner may include any known charge additives in amounts of from about 0.1 to about 10 wt %, from about 0.5 to about 7 wt % of the toner. Examples of such charge additives include alkyl pyridinium halides, bisulfates, the charge control additives of U.S. Pat. Nos. 3,944,493, 4,007,293, 4,079,014, 4,394,430 and 4,560,635, the entire disclosure of each of which herein is incorporated by reference in entirety, negative charge enhancing additives, such as, aluminum complexes, and the like.

Surface additives can be added to the toner compositions after washing or drying. Other examples of such surface additives include, for example, metal salts, metal salts of fatty acids, colloidal silicas, metal oxides, strontium titanates, mixtures thereof and the like. Surface additives may be present in an amount of from about 0.1 to about 10 wt %, from about 0.5 to about 7 wt % of the toner. Examples of such additives include those disclosed in U.S. Pat. Nos. 3,590,000, 3,720,617, 3,655,374 and 3,983,045, the entire disclosure of each of which herein is incorporated by reference in entirety. Other additives include zinc stearate and AEROSIL R972® (Degussa). The coated silicas of U.S. Pat. Nos. 6,190,815 and 6,004,714, the disclosure of each of which herein is incorporated by reference in entirety, also can be present in an amount of from about 0.05 to about 5%, from about 0.1 to about 2% of the toner, which additives can be added during aggregation or blended into the formed toner product.

The characteristics of the toner particles may be determined by any suitable technique and apparatus. Volume average particle diameter, $D_{50v}$, number average particle diameter, $D_{16n}$, $D_{50n}$, $GSD_v$, $GSD_n$ and so on are an example of useful parameters of characterizing particles and particle populations. Some metrics may be obtained by means of a measuring instrument, such as, a Beckman Coulter MULTISIZER 3, operated as recommended by the manufacturer. Cumulative particle distributions can be used to obtain various population parameters, which can be used to determine, for example, median size, amount of coarse particles, amount of fine particles and so on. The relative amount of fine particles can be determined from the $D_{50n}/D_{16n}$ value, which can be less than about 1.25, less than about 1.24, less than about 1.23, or lower. The percent of fine particles in the populations can be less than about 3.5%, less than about 3%, less than about 2.5%, or lower.

Utilizing the methods of the present disclosure, desirable gloss levels may be obtained. Thus, for example, the gloss level of a toner may have a gloss, as measured with a Gardner device of from about 20 gloss units (gu) to about 100 gu, from about 50 gu to about 95 gu, from about 60 gu to about 90 gu.

In embodiments, toners of the present disclosure may be utilized as low melt toners, such as, ultra low melt (ULM) toners. In embodiments, the dry toner particles, exclusive of external surface additives, may have the following characteristics:

(1) circularity of from about 0.9 to about 1 (measured with, for example, a Sysmex 3000), from about 0.95 to about 0.99, from about 0.96 to about 0.98;

(2) Tg of from about 45° C. to about 60° C., from about 48° C. to about 55° C.; and/or (3) melt flow index (MFI) in g/10 min (5 kg/130° C.) of from about 79.0 to about 172.5.

Toners may possess favorable charging characteristics when exposed to a variety of RH conditions. A low humidity zone (B zone) may be about 21° C./15% RH, while a high humidity zone (A zone) may be about 27° C./85% RH. Inclusion of a styrene/acrylate resin in the core provides improved charging of the toner particle under plural environmental conditions as compared to an analogous toner but containing only polyester in the core. Presence of a styrene/acrylate resin enables tuning or altering the composition to obtain a more robust toner particle that is optimized under plural environmental conditions, as revealed by testing and optimized performance in more than one zone, such as, A and B zones. The styrene/acrylate resin(s) also lessens or diminishes less desirable properties of polyester-only toner.

D) Developers

The toner particles thus formed may be formulated into a developer composition. For example, the toner particles may be mixed with carrier particles to achieve a two component developer composition. The toner concentration in the developer may be from about 1% to about 25% by weight of the total weight of the developer with the remainder of the developer composition being the carrier. However, different toner and carrier percentages may be used to achieve a developer composition with desired characteristics.

a) Carriers

Examples of carrier particles for mixing with the toner particles include those particles that are capable of triboelectrically obtaining a charge of polarity opposite to that of the toner particles. Illustrative examples of suitable carrier particles include granular zircon, granular silicon, glass, steel, nickel, ferrites, iron ferrites, silicon dioxide, one or more polymers and the like. Other carriers include those disclosed in U.S. Pat. Nos. 3,847,604; 4,937,166; and 4,935,326.

In embodiments, the carrier particles may include a core with a coating thereover, which may be formed from a polymer or a mixture of polymers that are not in close proximity thereto in the triboelectric series, such as, those as taught herein, such as, a hybrid of interest, or as known in the art. The coating may include fluoropolymers, terpolymers of styrene, silanes and the like. The coating may have a coating weight of, for example, from about 0.1 to about 10% by weight of the carrier.

Various effective suitable means can be used to apply the polymer to the surface of the carrier core, for example, cascade roll mixing, tumbling, milling, shaking, electrostatic powder cloud spraying, fluidized bed mixing, electrostatic disc processing, electrostatic curtain processing, combinations thereof and the like. The mixture of carrier core particles and polymer then may be heated to enable the polymer to melt and to fuse to the carrier core. The coated carrier particles then may be cooled and thereafter classified to a desired particle size.

E) Imaging Devices

The toners may be used for electrostatographic or electrophotographic processes, including those disclosed in U.S. Pat. No. 4,295,990, the entire disclosure of which herein is incorporated by reference in entirety. In embodiments, any known type of image development system may be used in an image developing device, including, for example, magnetic brush development, jumping single component development, hybrid scavengeless development (HSD) and the like. Those and similar development systems are within the purview of those skilled in the art.

Color printers commonly use four housings carrying different colors to generate full color images based on black plus the standard printing colors, cyan, magenta and yellow. However, in embodiments, additional housings may be desirable, including image generating devices possessing five housings, six housings or more, thereby providing the ability to carry additional toner colors to print an extended range of colors (extended gamut).

The following Examples are submitted to illustrate embodiments of the disclosure. The Examples are intended to be illustrative only and are not intended to limit the scope of the disclosure. Also, parts and percentages are by weight unless otherwise indicated. As used herein, "room temperature," refers to a temperature of from about 20° C. to about 30° C.

EXAMPLES

Example 1

EA Hybrid Toner in Continuous Coalescence (10% Styrene/Acrylate Resin)

Core particle preparation and aggregation were performed in a 20 gal reactor. An emulsion containing 28.72 kg deionized water (DIW), 3.790 kg cyan pigment dispersion, 3.440 kg IGI D1509 wax dispersion, 7.296 kg amorphous HMW polyester latex (200 nm, 76.6 k MW), 7.296 kg amorphous LMW polyester latex (200 nm, 18.1 k MW), 2.232 kg crystalline polyester latex (200 nm, 22.2 k MW) and 1.384 kg polystyrene/butylacrylate latex (185 nm, 34.5 k MW, $T_g$ of 51° C.) were mixed to form core particles. The core particles then were aggregated to a desired size and aggregation was stopped. A shell (28 wt %) of amorphous resin was added to the particles. The slurry, at a temperature of 49° C., then was fed into a continuous coalescence apparatus at a flow rate of 280 ml/min and the temperature was increased to a coalescence temperature of 92° C., at which point the slurry proceeded through two residence-time coils. The total volume of the continuous reactor was 280 ml. The coalesced slurry was quenched in the last heat exchanger to a temperature of 22° C. resulting in hybrid toner particles of a desired size (e.g. about 5 μm to about 6 μm). The toner particle is identified as A in Example 5 below.

The toner showed no degradation or fines increase through coalescence. The toner was passed through a 40 μm sieve to remove coarse particles and then separated from the mother liquor (ML) in a BUCHNER funnel under vacuum. The ML filtrate was transparent indicating there was no latex or wax expulsion in the ML during any of the steps for preparing the toner including aggregation, coalescing or washing.

Example 2

EA Hybrid Toner in Batch Coalescence (10% Styrene/Acrylate Resin)

Toner particles were prepared as described in Example 1, except coalescence was performed in a batch in the 20-gallon batch reactor. The final quenched particle specifications (e.g. size and morphology) closely matched those of the toner of Example 1.

Example 3

EA Hybrid Toner in Continuous Coalescence (5%; 25%; 35% and 50% Styrene/Acrylate Resin)

Toner particles were prepared as described in Example 1, except that instead of 10% styrene/acrylate resin, toner particles comprising 5% (B); 25% (C); 35% (D) and 50% (E) styrene/acrylate resin were prepared. The D and E samples each had a large percentage of fine particles.

Example 4

Control EA Polyester Toner in Batch or Continuous Coalescence

Polyester toner particles are prepared according to Example 1 or 2 with the exception that no styrene/acrylate resin is added to the resin emulsion for making the core.

Example 5

Measurement of Charging Properties to Toners

Triboelectric charge can be measured on toner panicles by the Faraday Cage process. The toner is mixed in a paint shaker (Red Devil 5400 at between 600 and 650 rpm) for a period of 20 min. That process simulates the mechanical energy input to a toner particle equivalent to that applied in a xerographic housing environment in a low toner throughput mode, that is, a xerographic housing producing a print in which from about 0 to about 2% of the print is covered by toner developed from that housing for a period of about 100 to about 10,000 impressions. The triboelectric charge is measured for the developers conditioned in, for example, A-zone (80° F./80% RH), B-zone (70° F./50% RH) or J-zone (70° F./10% RH).

The charging properties of the hybrid toner particles (formulated into a developer) comprising from 5% styrene/acrylate resin to 50% styrene/acrylate resin in the core prepared according to Examples 1 and 3 were compared to the control polyester toner particles of Example 4. The particle size distribution revealed the 35% and 50% styrene populations to contain a high percentage of fine particles.

Thus, focus was placed on hybrid toner particles containing no more than 10% of styrene/acrylate rein in the core. B zone tribo was found to be reduced in the hybrid toner as compared to the polyester-only control toner. The $D_{50n}/D_{16n}$ values were 1.219 (5%) and 1.211 (10%) as compared to 1.24 for the polyester-only control. The percentage of fines were 1.88% (5%) and 2.34% (10%) as compared to 3.1% for the polyester-only control. Thus, a lower level of fine particles occurs when 5% or 10% styrene/acrylate resin is present in the toner core.

It will be appreciated that various of the above-disclosed and other features and functions, or alternatives thereof, may be desirably combined into many other different systems or applications. Also various presently unforeseen or unanticipated alternatives, modifications, variations or improvements therein may be subsequently made by those skilled in the art, which are also intended to be encompassed by the following claims. Unless specifically recited in a claim, steps or components of claims should not be implied or imported from the specification or any other claims as to any particular order, number, position, size, shape, angle, color or material.

The entire content of the references cited herein are incorporated by reference in entirety.

We claim:

1. A hybrid toner comprising at least one polyester resin, no more than 10% by weight of core resin of at least one styrene/acrylate resin, optionally a wax, optionally a colorant and a shell, wherein the hybrid toner possesses one or more of: (a) less sensitivity to relative humidity as compared to a polyester toner without the polystyrene/acrylate resin; (b) a lower percentage of fine particles; (c) higher A zone charge; (d) lower B zone charge; or (e) lower J/A ratio.

2. The toner of claim 1, wherein said shell comprises from about 22% to about 35% by weight of the toner.

3. The toner of claim 1, wherein the polystyrene/acrylate resin is present at least 5% by weight of the toner.

4. The toner of claim 1, wherein the polystyrene/acrylate resin is present at about 10% by weight of the toner.

5. The toner of claim 1, comprising an amorphous polyester resin, a crystalline polyester resin or both.

6. The toner of claim 1, comprising at least one crystalline polyester resin.

7. The toner of claim 1, comprising at least one amorphous polyester resin.

8. The toner of claim 7, wherein the at least one amorphous polyester resin comprises low molecular weight resin, high molecular weight resin or both.

9. The toner of claim 8, wherein the low molecular weight resin is no more than about 25,000 molecular weight and the high molecular weight resin is at least about 70,000 molecular weight.

10. The toner of claim 1, wherein the styrene/acrylate resin is selected from styrene acrylates, styrene butadienes, styrene methacrylates and combinations thereof.

11. The toner of claim 1, wherein the styrene/acrylate resin is selected from poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), poly(styrene-butadiene), poly(styrene-isoprene), poly(styrene-butyl methacrylate), poly(styrene-butyl acrylate-acrylic acid), poly(styrene-butyl methacrylate-acrylic acid), poly(butyl methacrylate-butyl acrylate), poly(butyl methacrylate-acrylic acid), poly(acrylonitrile-butyl acrylate-acrylic acid), and combinations thereof.

12. The toner of claim 1, comprising a wax comprising a melting point of no more than 100° C.

13. The toner of claim 1, wherein said shell comprises a polyester resin.

14. The toner of claim 1, comprising an emulsion/aggregation toner.

15. The toner of claim 1, wherein coalescence of said particle occurs in a continuous reactor.

16. The toner of claim 1, wherein the fine particles comprise less than about 5% of the population.

17. The toner of claim 1, wherein said particles comprise a $D_{50n}/D_{16n}$ less than about 1.25.

18. The toner of claim 1, comprising a lower B zone charge.

19. The toner of claim 1, comprising a lower J/A ratio.

20. The toner of claim 1, wherein said BET surface area is greater than about 2.

* * * * *